US005534908A

United States Patent [19]

Takeda et al.

[11] Patent Number: 5,534,908

[45] Date of Patent: Jul. 9, 1996

[54] THERMAL TRANSFER RECORDER WITH INK SHEET AND RECORDING MEDIUM CONVEYED ACCORDING TO RECORDING MODE

[75] Inventors: Tomoyuki Takeda, Yokohama; Takehiro Yoshida, Tokyo; Takeshi Ono, Yokohama; Satoshi Wada, Kawasaki; Masaya Kondo, Tokyo; Makoto Kobayashi, Tama; Takahiro Kato, Yokohama; Minoru Yokoyama, Yokohama; Akihiro Tomoda, Yokohama; Yasushi Ishida, Tokyo; Takashi Awai; Masakatsu Yamada, both of Yokohama, all of Japan

[73] Assignee: Canon Kabushiki Kaisha, Tokyo, Japan

[21] Appl. No.: 528,608

[22] Filed: Sep. 15, 1995

Related U.S. Application Data

[63] Continuation of Ser. No. 182,388, Jan. 18, 1994, abandoned, which is a continuation of Ser. No. 648,054, Jan. 30, 1991, abandoned.

[30] Foreign Application Priority Data

| | | | |
|---|---|---|---|
| Feb. 1, 1990 | [JP] | Japan | 2-20403 |
| Feb. 1, 1990 | [JP] | Japan | 2-20404 |
| Feb. 1, 1990 | [JP] | Japan | 2-20406 |

[51] Int. Cl.[6] ..... B41J 11/42

[52] U.S. Cl. ..... 347/215; 347/188; 347/171

[58] Field of Search ..... 347/215, 171, 347/188

[56] References Cited

U.S. PATENT DOCUMENTS

| | | | |
|---|---|---|---|
| 4,737,860 | 4/1988 | Ono et al. | 346/76 PH |
| 4,953,108 | 8/1990 | Kato et al. | 364/523 |

FOREIGN PATENT DOCUMENTS

| | | | |
|---|---|---|---|
| 58-201686 | 11/1983 | Japan . | |
| 0095177 | 6/1984 | Japan . | |
| 59-145161 | 8/1984 | Japan . | |
| 60-143981 | 7/1985 | Japan . | |
| 0232988 | 11/1985 | Japan | 400/232 |
| 0050182 | 3/1987 | Japan | 400/232 |

*Primary Examiner*—Huan H. Tran

*Attorney, Agent, or Firm*—Fitzpatrick, Cella, Harper & Scinto

[57] ABSTRACT

In a thermal transfer recording apparatus, an ink sheet and a recording medium are separately conveyed, an image is recorded on the recording medium, and the recording mode is discriminated. The conveyance amounts of the ink sheet and recording medium are controlled in accordance with the recording mode so that the density of the recorded image is maintained constant.

12 Claims, 15 Drawing Sheets

| |
|---|
| FIG. 5A |
| FIG. 5B |

FIG. 7

| MOVING DISTANCE AT HALF-STEP | | $\frac{1}{15.4}$ mm |
|---|---|---|
| NUMBER OF STEPS FOR ONE LINE | SUPER FINE | 1 |
| | FINE | 2 |
| | STANDARD | 4 |

FIG. 8

| MOVING DISTANCE AT HALF-STEP | | | $\frac{1}{15.4} \times \frac{1}{5} \times \frac{1}{5}$ mm |
|---|---|---|---|
| NUMBER OF STEPS FOR ONE LINE | SUPER FINE | n → LARGE | 4 |
| | | n → MEDIUM | 5 |
| | | n → SMALL | 6 |
| | FINE | n → LARGE | 8 |
| | | n → MEDIUM | 10 |
| | | n → SMALL | 12 |
| | STANDARD | n → LARGE | 16 |
| | | n → MEDIUM | 20 |
| | | n → SMALL | 24 |

THERMAL TRANSFER RECORDER WITH INK SHEET AND RECORDING MEDIUM CONVEYED ACCORDING TO RECORDING MODE

This application is a continuation of application Ser. No. 08/182,388 filed Jan. 18, 1994 abandoned, which is a continuation of application Ser. No. 07/648,054 filed Jan. 30, 1991, abandoned.

BACKGROUND OF THE INVENTION

1. Field of the Invention

The present invention relates to a thermal transfer recording apparatus and a facsimile apparatus for recording image on recording medium by transferring ink contained in an ink sheet to the aforesaid recording medium.

2. Related Background Art

Generally, a thermal transfer printer uses an ink sheet with heat meltable (or heat sublimable) ink coated on the base film thereof, and selectively heats such ink sheet by the thermal head in response to image signals in order to transfer the molten (or sublimated) ink to a recording sheet for image recording. Usually, an ink sheet of the kind is such that the contained ink is completely transferred to the recording sheet for one image recording (the so-called one-time sheet). Therefore, it is necessary to convey the ink sheet for an amount equivalent to the length of recorded one character or one line of image after the image recording has been completed, so that the unused portion of the ink sheet should reliably be brought forward to the position for the next recording. Thus the consumption of the ink sheet becomes great and the running cost of the thermal transfer printer tends to be higher than that of a usual thermal printer using thermal sheets for recording.

With a view to solving a problem such as this, a thermal transfer printer has been proposed, in which both recording sheet and ink sheet are conveyed in the same direction at different speeds, as disclosed in Japanese Laid-Open Patent Applications Nos. 57-83471 and 58-201686 or Japanese Patent Publication No. 62-58917. As described in the aforesaid publications, an ink sheet (multiprint sheet) capable of recording images for plural numbers (n) is known. When a length L of recording is continuously performed using this ink sheet, it is possible to carry on the recording by making the length of ink sheet to be conveyed after each image recording has been completed or during the image being recorded shorter than the length L by (L/n:n>l). Hence the ink sheet can be used more efficiently than the conventional sheet by n times, and it is therefore expected that the running cost of the thermal transfer printer is lowered. Hereinafter this recording method is referred to as multiprint.

In the conventional multiprint, however, said n value is constant irrespective of printing modes. In the case of a thermal transfer printer generally in use, the faster the recording speed is, the greater is the ratio of the period to energize the thermal head. Consequently, the temperature of the thermal head is raised, so that ink contained in the ink sheet is easily molten or sublimated. As a result, if this ink sheet is employed for a facsimile apparatus or the like for example, the recording density becomes thin for a superfine mode, etc. necessitating a slower recording speed, whereas the recording density is thick for a standard mode which is a higher speed recording. On the contrary, if the recording is performed just fine with this ink sheet in the superfine mode, the density becomes too high in the standard mode, and there is a possibility that the recorded image is smeared.

Also, in a facsimile apparatus, etc., when the transfer speed is fast, requiring a shorter cycle of scanning or recording, the heat is accumulated on the thermal head to cause the thermal head to generate a higher temperature. Accordingly, the image transfer becomes easier because ink contained in the ink sheet is molten. On the other hand, if the transfer speed is slow, making the cycle of scanning or recording longer, the thermal head is cooled at each of the intervals between the recording periods, thus making it difficult to transfer ink contained ink sheet.

In the conventional apparatus, however, the length (n) to convey the ink sheet against the recording sheet is always fixed for a constant value as described earlier. Therefore, there is a possibility that the amount of ink transfer of the ink sheet varies due to such variations of recording cycle, etc., and that the densities of recorded images vary to lower the image quality.

Likewise, in a half tone mode, etc., for example, necessitating a slower recording speed, the cycle to energize the thermal head also becomes longer, so that the temperature of the thermal head is lowered. Then ink contained in the ink sheet tends to be difficult to be molten or sublimated. However, since the aforesaid n value is fixedly set for the above-mentioned thermal transfer printer, the relative speed between the recording sheet and ink sheet remains unchanged even in a state where it is difficult to transfer ink contained in the ink sheet. As a result, there is a possibility that the amount of ink transfer is reduced to cause the density of the recorded image to be lowered.

As set forth above in detail, there is a possibility that the image quality is lowered by the influence of heat accumulation when the recording mode (such as standard mode, fine mode, recording cycle, half tone mode, or the like) is shifted because the aforesaid n value is constant in the conventional multiprint.

SUMMARY OF THE INVENTION

An object of the present invention is to provide a thermal transfer recording apparatus and a facsimile apparatus wherein the image quality is not lowered.

Another object of the present invention is to provide a thermal transfer recording apparatus and a facsimile apparatus, in which a constant image quality can be maintained even if recording modes are shifted.

Still another object of the present invention is to provide a thermal transfer recording apparatus and a facsimile apparatus, in which the constant recording density can be maintained by adjusting the amount to convey the ink sheet against the recording medium in response to the recording density and/or recording speed.

Yet another object of the present invention is to provide a thermal transfer recording apparatus and a facsimile apparatus, in which an excellent image can be recorded by saving the ink sheet by reducing the amount to convey the ink sheet against the recording medium when the recording speed is fast while making the amount to convey the ink sheet large when the recording speed is slow.

A further object of the present invention is to provide a thermal transfer recording apparatus and a facsimile apparatus, in which a half tone image can be recorded with a similar density of the other images by increasing the amount to convey the ink sheet against the recording medium when the half tone image is recorded.

BRIEF DESCRIPTION OF THE DRAWINGS

FIG. 7 is a view showing the distance to convey the recording sheet in each of the modes according to the present embodiment.

FIG. 8 is a view showing-the distance to convey the ink sheet in each of the modes according to the present invention.

DETAILED DESCRIPTION OF THE PREFERRED EMBODIMENTS

Hereinafter, the embodiments suited for the present invention will be described in detail with reference to the accompanying drawings. Each of the embodiments hereinafter set forth is an example in which the lowering of image quality is not generated even when the recording modes are shifted.

At first, the embodiment, which will be described in conjunction with FIG. 1–FIG. 5, enables an amount to convey ink sheet to be automatically optimized in response to any one of the standard, fine, and superfine modes selected (by an operator) as a recording mode.

DESCRIPTION OF A FACSIMILE APPARATUS (FIG. 1–FIG. 4)

Figure 1:
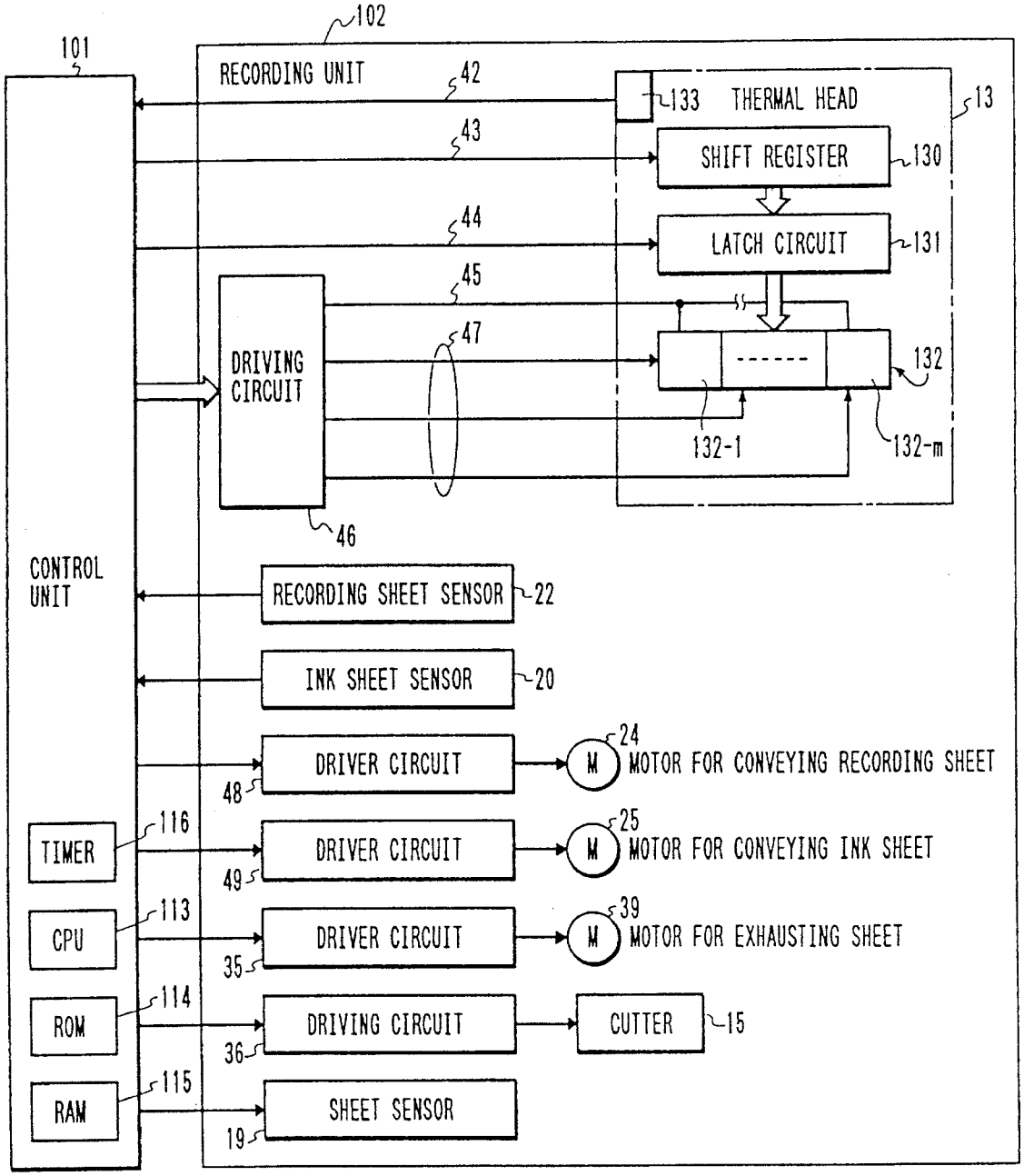
FIG. 1 is a block diagram showing the control unit and recording unit of a facsimile apparatus according to an embodiment to which the present invention is applied.
Figure 2:
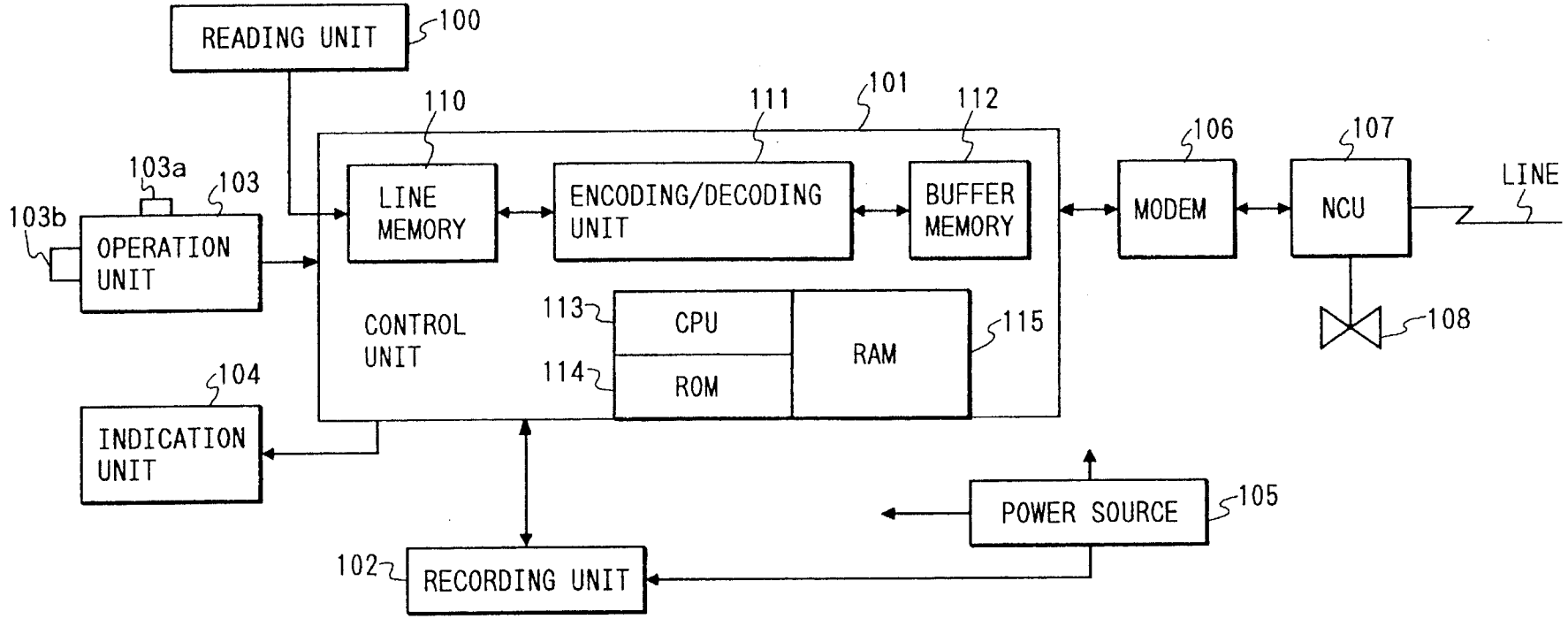
FIG. 2 is a block diagram showing the schematic structure of a facsimile apparatus according to the present embodiment.
Figure 3:
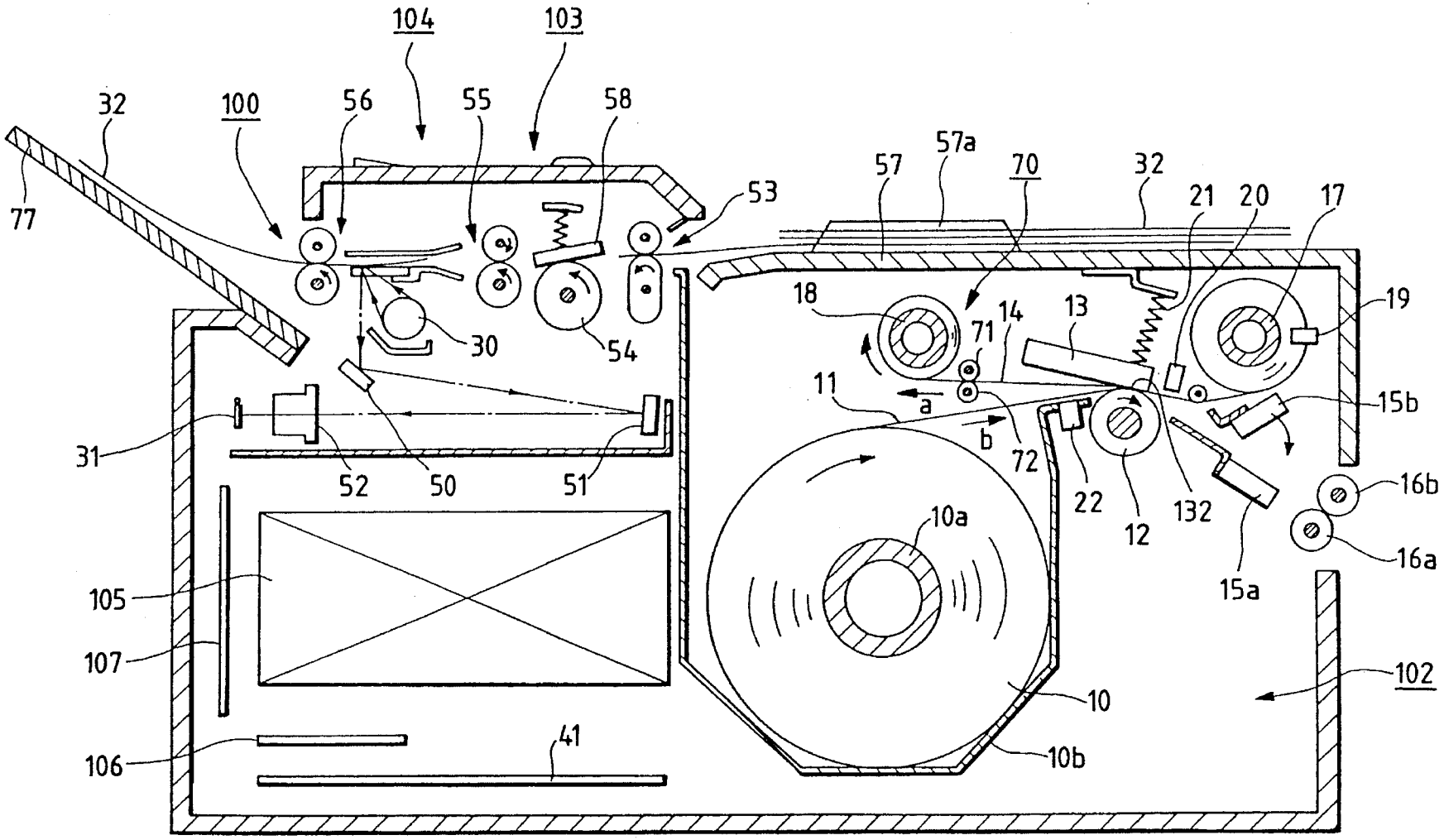
FIG. 3 is a cross-sectional side view showing the mechanical section of a facsimile apparatus according to the present embodiment.
Figure 4:
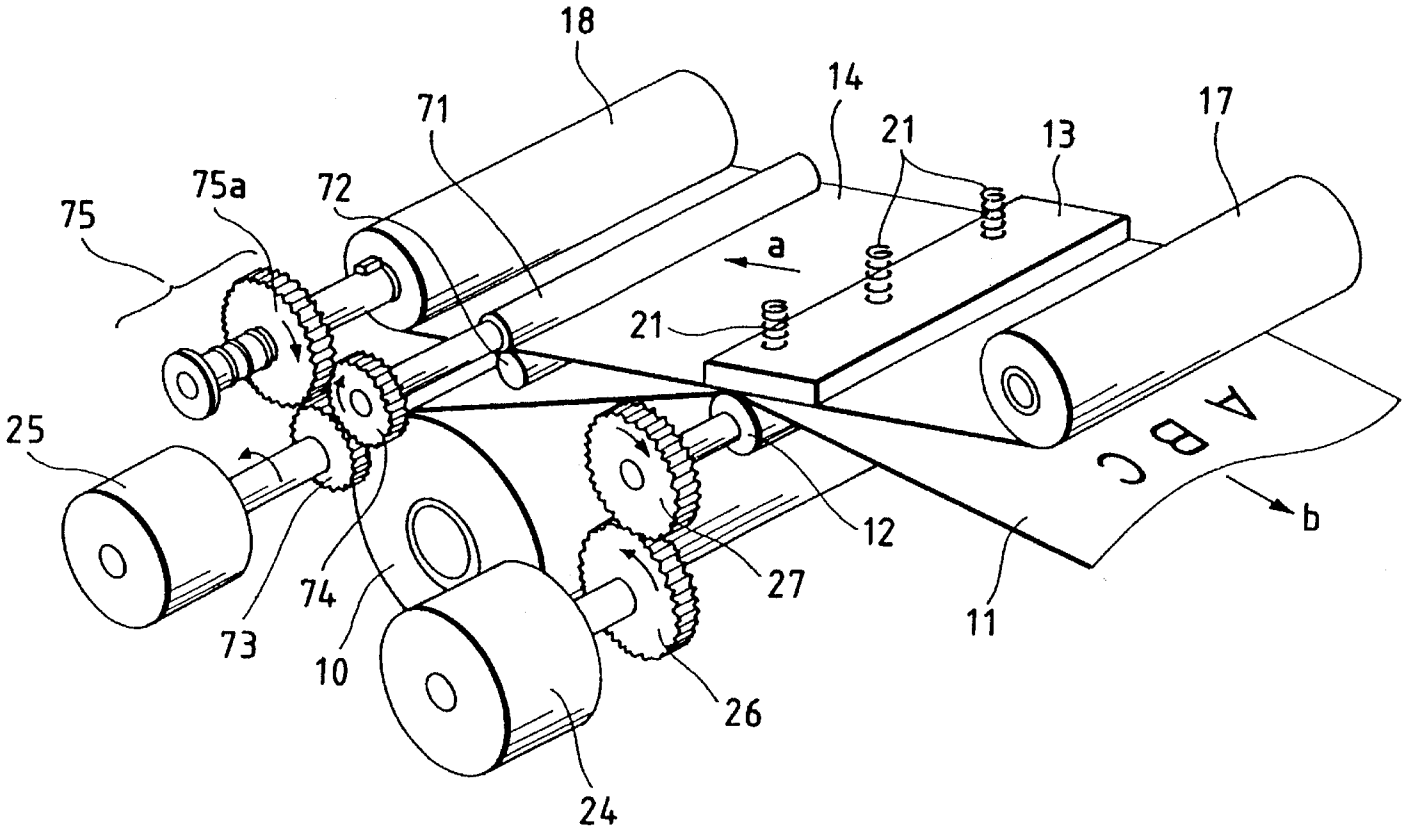
FIG. 4 is a perspective view showing the mechanism to convey the recording sheet and ink sheet according to the present embodiment.

FIG. 1–FIG. 4 are views showing an example of a facsimile apparatus to which a thermal transfer printer using an embodiment of the present invention is applied. FIG. 1 illustrates the electrical connection between the control unit and the mechanical unit. FIG. 2 is a block diagram showing the schematic structure of the facsimile apparatus. FIG. 3 is a cross-sectional view of the facsimile apparatus, and FIG. 4 is a view showing the mechanism to convey the recording sheet and the ink sheet.

At first, the schematic structure of a facsimile apparatus according to the present embodiment will be described in conjunction with FIG. 2.

In FIG. 2, a numeral 100 denotes a reading unit comprising a motor for conveying original, CCD image sensor, etc. to read an original photoelectrically and output it into control unit 101 as digital image signals. Next, the structure of this control unit 101 is described. A numeral 110 denotes a line memory to store image data from each line of an image data. When the original is transmitted or coped, image data of one-line portion from reading unit 100 is stored, and when image data is received, a one-line data of the decoded image data is stored therein. Then an image recording is performed by outputting the stored data into recording unit 102. A numeral 111 denotes an encoding/decoding unit to encode an image information to be transmitted by MH encoding, etc. and at the same time, to decode an encoded image data received and convert it into the image data. Also, a numeral 112 denotes a buffer memory to store encoded image data to be transmitted or received. Each of these units in the control unit 101 is controlled by CPU 113 such as a microprocessor, etc. In the control unit 101, there are provided, in addition to this CPU 113, ROM 114 storing a control program for the CPU 113 and various kinds of data and RAM 115 temporarily storing various kinds of data as work area for the CPU 113, and others.

A numeral 102 denotes a recording unit comprising a thermal line head to perform recording on recording sheet by the use of thermal transfer method. This structure will be described later in detail with reference to FIG. 3. A numeral 103 denotes an operation unit including instruction keys for each function such as transmission start, etc., input keys for telephone numbers, and others; 103*a* designates a switch for instructing the kind of ink sheet to be used, which indicates that a multiprint ink sheet is in use when the switch 103*a* is on, and that .an ordinary ink sheet is in use when the switch is off; also 103*b* designates a switch for shifting the recording speeds from high to low and vice versa. In this respect, the recording speed can be shifted in response to a judgement based on a communication protocol with the equipment of the side of the other party as described later, and not necessarily by manual operation; 104 denotes an indication unit usually installed adjacent to the operation unit 103 to display the state of each of the functions, systems, etc.; 105 is a power source to supply electric power to the entire system; 106 is a MODEM (modulator/demodulator); 107 is a network control unit (NCU) for performing an automatic receiving by detecting a ringing tone and line control; and 108 is a telephone set.

Next, with reference to FIG. 3, the structure of recording unit 102 is described. Hereinafter a unit which is common in each of the figures will be designated by a same number.

In FIG. 3, a numeral 10 denotes a rolled sheet formed by an ordinary recording sheet 11 which is wound around a core 10*a*. This rolled sheet 10 is accommodated in the apparatus freely rotatably so that the recording sheet 11 can be supplied to the thermal head unit 13 by the rotation of platen roller 12 in the direction indicated by an arrow. In this respect, a numeral 10*b* denotes a rolled sheet housing in which the rolled sheet 10 can detachably be accommodated. Further, a numeral 12 denotes a platen roller for conveying the recording sheet 11 in the direction indicated by an arrow b and at the same time, for pressing the ink sheet 14 and recording sheet 11 between the platen roller and the heat generating resistor 132 of thermal head 13. The recording sheet 11 is conveyed by the further rotation of platen roller 12 in the direction towards exhausting rollers 16 (16*a* and 16*b*) after the image recording has been completed by the heat generation of thermal head 13, and is cut into the unit of one page by the engagement of cutters 15 (15*a* and 15*b*) when the image recording for the one-page portion is completed.

A numeral 17 denotes an ink sheet supply roller with ink sheet 14 wound around thereon. A numeral 18 denotes an ink sheet winding roller driven by a motor for conveying ink sheet which will be described later to take up the ink sheet 14 in the direction indicated by an arrow a. In this respect, these ink sheet supply roller 17 and ink sheet winding roller 18 are detachably accommodated in an ink sheet housing 70 in the main body of the apparatus. Further, a numeral 19 denotes a sensor for detecting the remaining quantity of ink sheet 14 and the speed at which ink sheet 14 is being conveyed. Also, a numeral 20 denotes an ink sheet sensor for detecting the presence of ink sheet 14; 21 is a spring compressing thermal head 13 against platen roller 12 through recording sheet 11 and ink sheet 14; and 22 is also a recording sheet sensor for detecting the presence of the recording sheet.

Subsequently the structure of reading unit 100 will be described.

In FIG. 3, a numeral 30 is a light source for irradiating original 32, and the reflected light from original 32 is inputted into CCD sensor 31 through an optical system (mirrors 50 and 51, and lens 52), which is converted into electrical signal. The original 32 is conveyed by carrier rollers 53, 54, 55, and 56 driven by a motor (not shown) for conveying original in accordance with a speed at which the original 32 is being read. In this respect, a numeral 57 denotes an original stacker. The plural sheets of originals 32 stacked on this stacker 57 are separated one by one by the cooperation of carrier roller 54 and pressurized separator 58 while being guided by slider 57*a* and conveyed to reading unit 100. Then after being read, the original is exhausted onto tray 77.

A numeral 41 denotes a control board constituting the major part of control unit 101. From the control board 41 various controlling signals are output to each of the units in the apparatus. Also, a numeral 105 denotes a power source to supply electric power to each unit; 106 is a MODEM board unit; and 107 is an NCU board unit having functions to relay telephone lines.

Further, FIG. 4 is a perspective view showing the details of mechanism to convey both ink sheet 14 and recording sheet 11.

In FIG. 4, a numeral 24 designates a motor for conveying recording sheet to rotationally drive platen roller 12 to convey recording sheet 11 in the direction indicated by an arrow b which is opposite to the direction indicated by an arrow a. Also, a numeral 25 designates a motor for conveying ink sheet to convey ink sheet 14 in the direction indicated by an arrow a by rotating capstan roller 71 and pinch roller 72. Further, numerals 26 and 27 are transmission gears to transmit the rotation of motor 24 for conveying recording sheet to platen roller 12; 73 and 74 are transmission gears to transmit the rotation of motor 25 for conveying ink sheet to capstan roller 71; and 75 is a sliding clutch unit.

Here, by setting the ratio between gears 74 and 75 so as to make the length of ink sheet 14 taken up by the winding roller 18 driven by the rotation of gear 75*a* longer than the length of ink sheet conveyed by capstan roller 71, the ink sheet 14 having been conveyed by capstan roller 71 is reliably taken up by winding roller 18. Then, an amount equivalent to the difference between the amount of ink sheet 14 taken up by winding roller 18 and that of ink sheet 14 conveyed by capstan roller 71 is absorbed by sliding clutch unit 75. In this way, it is possible to restrict the variation of the speed (amount) to convey ink sheet 14 caused by the changing diameter of winding roller 18 as the winding advances.

FIG. 1 is a diagram showing the electrical connection between control unit 101 and recording unit 102 in a facsimile apparatus according to the present embodiment, and a unit which is common in the other figures is designated by a same reference number.

The thermal head 13 is a line head. Then, this thermal head 13 comprises a shift register 130 for inputting a one-line portion of the serial recording data from control unit 101 and shift clock 43; a latch circuit 131 for latching data in shift register 130 by latch signal 44; and a heat generating element comprising a heat generating resistor for one line portion. Here, the heat generating resistor 132 is divided into m blocks indicated by numerals 132-1 to 132-m for driving. Also, a numeral 133 denotes a temperature sensor installed on thermal head 13 for detecting the temperature of thermal head 13. The output signal 42 of this temperature sensor 133 is inputted into said CPU 113 after an A/D conversion executed in control unit 101. Thus CPU 113 detects the temperature of thermal head 13 to adjust the amplitude of strobe signal 47 or the driving voltage of thermal head 13 and changes the applied energy to thermal head 13 in accordance with the characteristics of ink sheet 14. A numeral 116 is a programmable-timer. Its timing is set by CPU 113, and when the start of timing is instructed, the timer starts timing to actuate CPU 113 to output interrupt signal, time-out signal, etc. respectively at each time indicated.

In this respect, the characteristics (kinds) of ink sheet 14 may be determined by the use of the aforesaid switch 103*a* in operation unit 103 or the detection of marks, etc. printed on ink sheet 14, or the detection of marks, cut-off, projection or the like provided for a cartridge, etc.

A numeral 46 is a driving circuit to receive the driving signal for thermal head 13 from control unit 101 to output strobe signal 47 for driving thermal head 13 by the unit of each block. In this respect, the driving circuit 46 enables the applied energy to thermal head 13 to be changed by adjusting the voltage output to source line 45 which supplies electric current to the heat generating element 132 of thermal head 13 in accordance with instruction from control unit 101. A numeral 36 is a driving circuit including a motor for driving cutter to drive cutters 15 for its engagement. A numeral 39 is a motor for exhausting sheet to rotatably drive exhausting sheet rollers 16. Numerals 48, 49, and 35 are motor driving circuits to drive motor 24 for conveying recording sheet, motor 25 for conveying ink sheet, and motor 39 for exhausting sheet respectively.

Numeral 141 and 142 are motor control signals respectively for controlling the step number and excitation of each of the motors 24 for conveying recording sheet and 25 for conveying ink sheet. In this respect, motor 24 for conveying recording sheet, motor 25 for conveying ink sheet, and motor 39 for exhausting sheet are stepping motors in the present embodiment. These motors, however, are not limited thereto, and for example, DC motors or the like may also be applicable.

DESCRIPTION OF RECORDING PROCESS (FIG. 1–FIG. 5)

Figures 5, 5A:
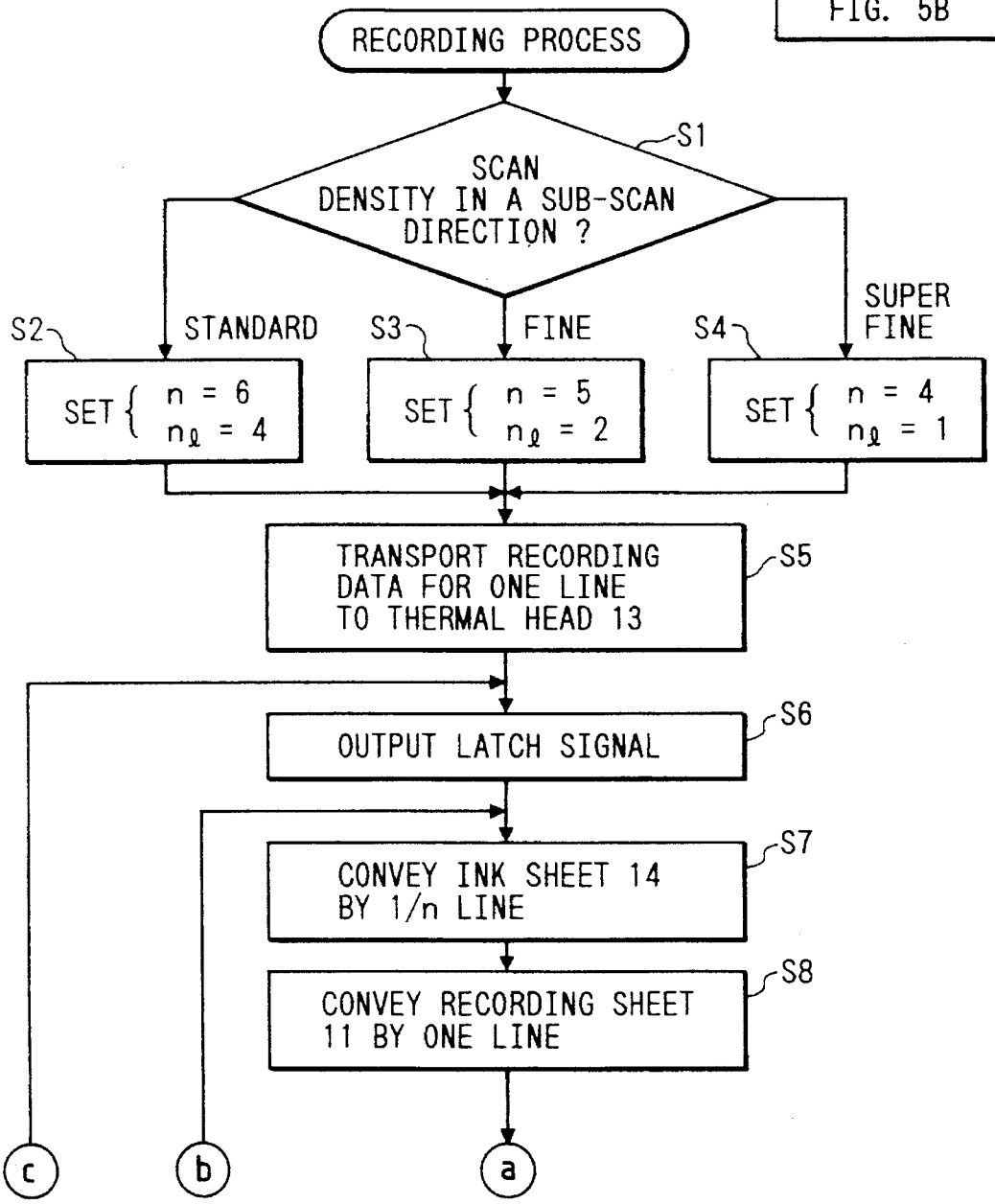
FIG. 5 comprises FIG. 5A and FIG. 5B, which are connected flowcharts.
Figure 5B:
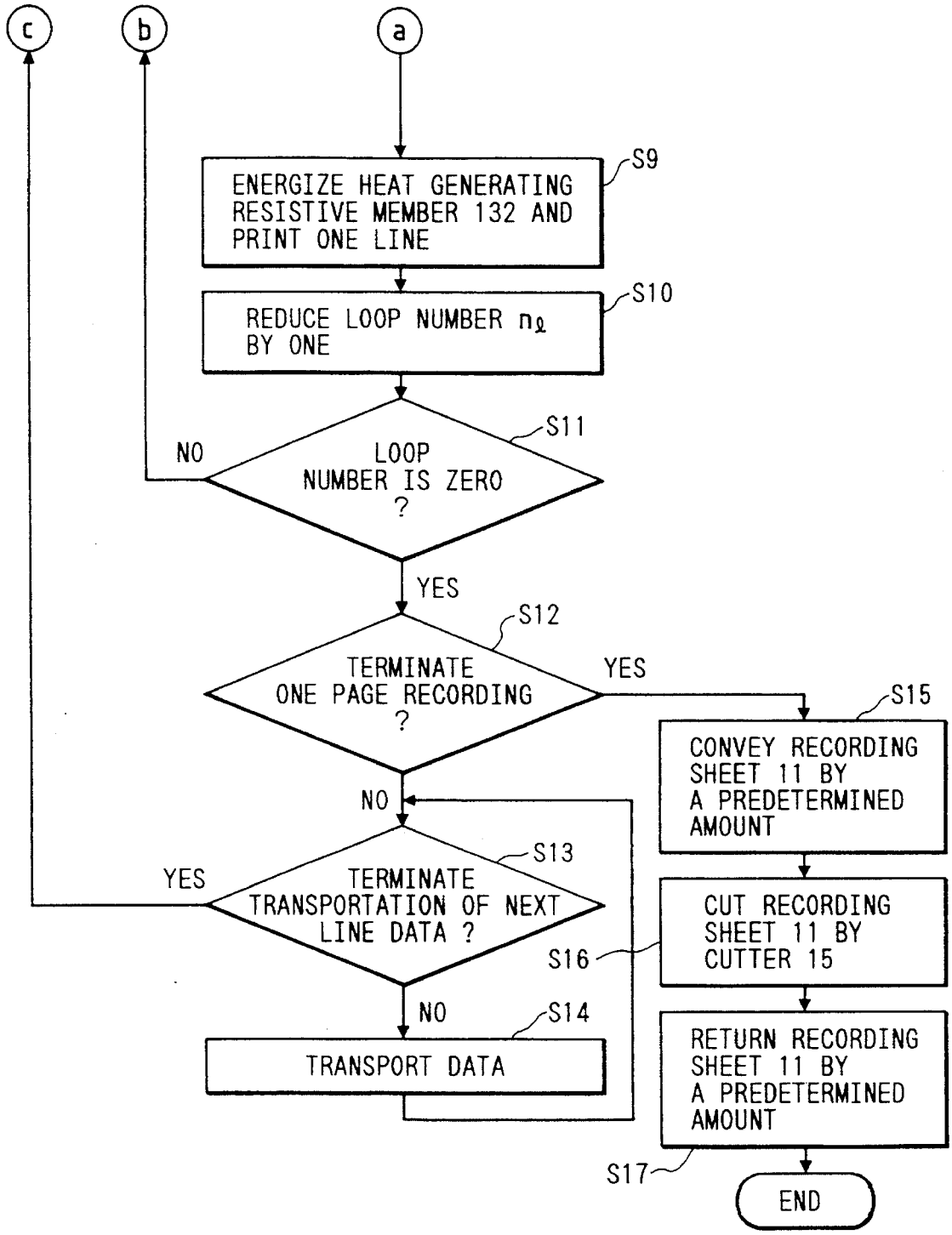

FIG. 5 is a flowchart showing image recording process for a one-page portion in a facsimile apparatus according to the present embodiment. The control program for executing this process is stored in ROM 114 in control unit 101. This process is started when the image recording action is ready to start with the one-line portion of image data stored in line memory 110 for the image to be recorded.

First, at a step S1, the image to be recorded is detected to determine whether the image is to be recorded in the standard mode, fine mode, or superfine mode. This discrimination takes place during the process of receiving or transmitting facsimile signals. Here, if the image is to be recorded in the standard mode, the process proceeds to a step S2 where the multiprinting number n is set at "6" while the loop number nl is set at "4". If the image is to be recorded in the fine mode, the process proceeds to a step S3 where with n=5, the loop number nl is set at "2". Further, if the image is to be recorded in the superfine mode, the process proceeds to a step S4 where with n=4, the loop number nl is set at "1".

When the value n and the loop number nl thus established, the process proceeds to a step S5 to output a one-line portion of recording data in serial to shift register 130. Then, when the transportation of the recording data for the one line is completed, latch signal 44 is output at a step S6 to store the one-line portion of recording data in latch circuit 131. Next, at a step S7, motor 25 for conveying ink sheet is driven to convey ink .sheet 14. At this juncture, if a multiprinting has been instructed by switch 103*a*, the ink sheet is conveyed in the direction indicated by an arrow a in FIG. 4 for a portion of (l/n) of the height of one line (1/15.4 mm) of recording sheet 11. The adjustment of n value such as this can be executed by changing the step number of motor 24 for conveying ink sheet by motor control signal 142.

Then, at a step S8, motor 24 for conveying recording sheet is driven to convey recording sheet 11 in the direction indicated by an arrow b for a one-line portion (1/15.4 mm). In this respect, this one-line portion is a length equivalent to the length of one dot of the image to be recorded by thermal head 13. Next, the process proceeds to a step S9 to energize each of the blocks of heat generating element 132 of thermal head 13. Then, when the entire blocks m of thermal head 13 are all energized to complete the image recording across the width of the one line, the process proceeds to a step S10 to set −1 for the loop number established at either one of the steps S2 to S4. Thus, at a step S11, the loop number is examined to determine whether it becomes to be "0", and if it is not found to be "0", the process returns to the step S7 and record again the image of the same line.

Hence in the present embodiment, a same data is recorded four times across the width of the recording line in the standard mode and two times in the fine mode so as to make the density of the recorded lines in the sub-scan direction (that is, perpendicular to the direction of recording sheet conveyance) equal as compared with the case of superfine mode recording.

In this way, when the recording for one line is completed, the process proceeds to a step S12 from the step S11 to examine whether or not the image recording for one page has been completed. If the image recording for one page has not been completed as yet, the process proceeds to a step S13 to determine whether or not recording data for the next line has been transported to thermal head 13 during the course of the aforesaid processing step. If the transportation has been completed, the process returns to the step S6 to latch a one-line portion of image data to latch circuit 131 by latch signal. However, if the transportation has not been completed as yet, the process proceeds to a step S14 to execute the transportation until the entire data of the next line is completely transported to thermal head 13 and returns to the step S6.

When the image recording for one page has been completed at the step S12, the process proceeds to a step S15 to convey a predetermined amount of recording sheet 11 in the direction towards exhausting sheet rollers 16 (16*a* and 16*b*). Then at a step S16, cutters 15 (15*a* and 15*b*) are driven to engage with each other to cut recording sheet 11 into a unit of one page. Subsequently, the recording sheet 11 thus cut is exhausted by exhausting rollers 16 to the outside of the apparatus and at the same time, the remaining recording sheet 11 is withdrawn at a step S17 for a distance equivalent to the space between thermal head 13 and cutters 15. Thus the recording process for one page is terminated.

As the above describes, according to the present embodiment, it is possible to prevent any variations in the density of the recorded line regardless of the recording mode used by making the n value great in the standard mode where the amount of recording sheet conveyed is large and the recording speed is fast while making the n value small in such mode as superfine where the amount of recording sheet convey is small and the recording speed is slow.

Also, according to the present embodiment, it is possible to perform recording in standard mode using a small amount of ink sheet used, and the ink sheet is effectively saved as compared with the cases of fine and superfine mode recordings.

In addition, according to the present embodiment, the n values are established in response to the transmitting and receiving modes because the example has been taken of a facsimile apparatus, but the present invention is not limited to this. For example, it is also possible to adjust the value in response to the recording density and recording speed in the direction of sub-scanning.

As set forth above, according to the present embodiment, the ratio of the amounts to convey recording medium and ink sheet is made greater when the recording density is rough or the recording speed is fast, and that of the amounts to convey recording medium and ink sheet is made smaller when the recording density is fine or the recording speed is slow. Hence there is an effect that the recording density can be maintained almost at a constant level.

Subsequently, as an embodiment wherein the image quality is not lowered even when recording modes are shifted, an example will be described, in which an action is taken to adjust an amount to convey ink sheet against recording medium for a recording in response to the recording speed detected by detecting means for detecting recording speed or the recording speed instructed by an equipment on the side of the other party. In this respect, the aforesaid FIG. 1 to FIG. 4 and the descriptions thereof are referenced in the embodiment hereinafter set forth.

Figure 6A:
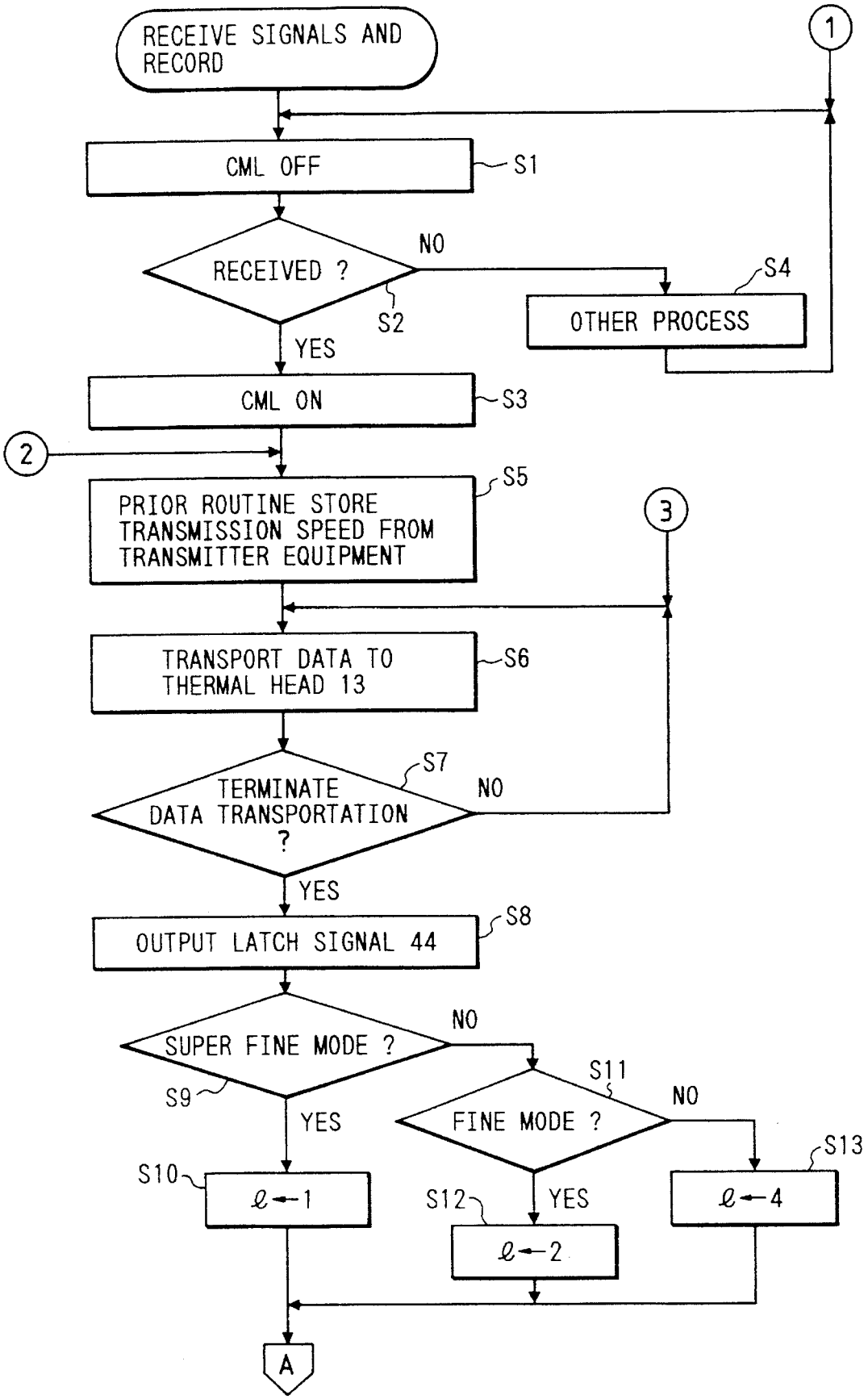
FIGS. 6A–6C are flowcharts showing the receiving and recording processes in a facsimile apparatus according to the present embodiment.
Figure 6B:
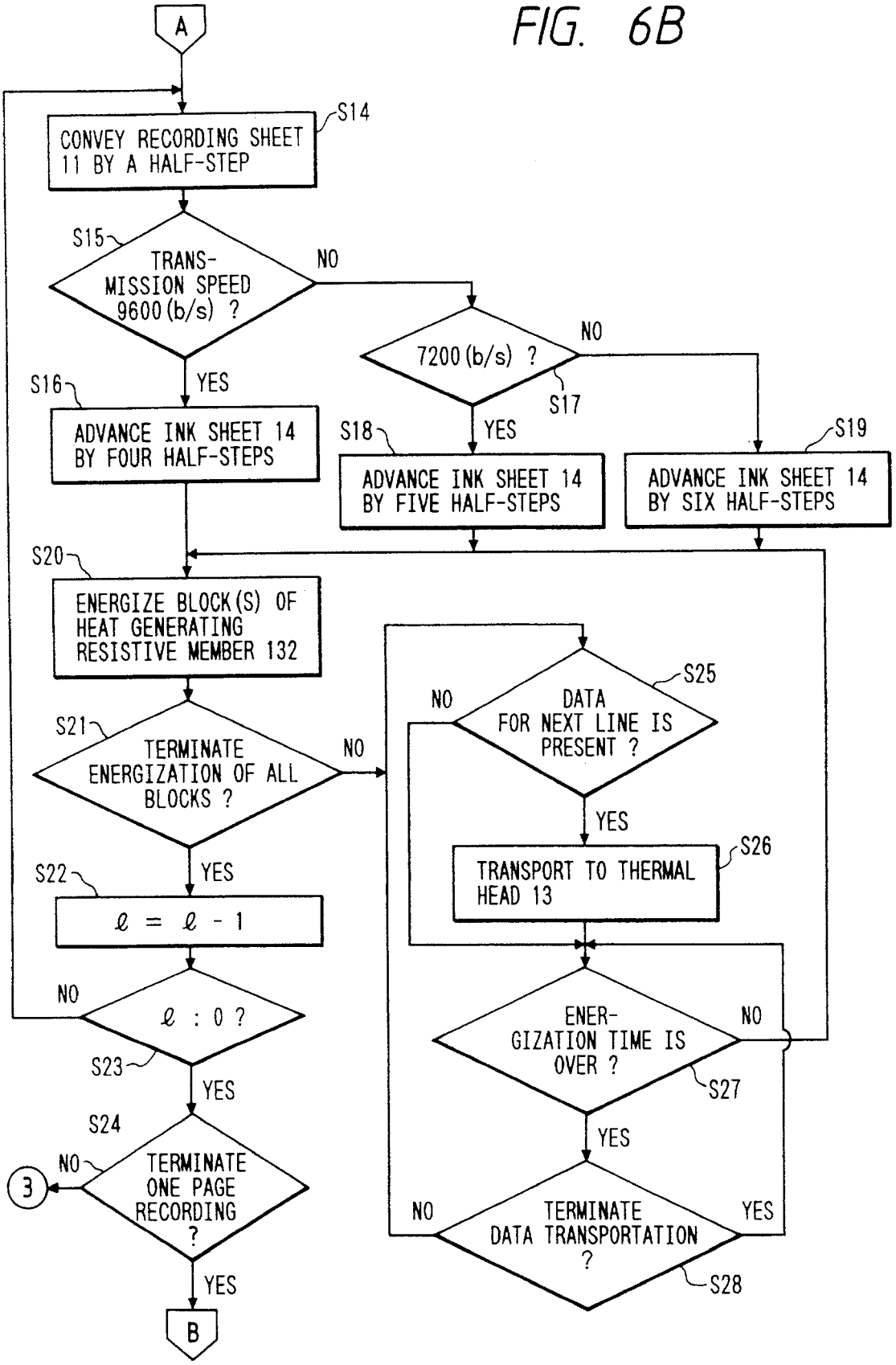
Figure 6C:
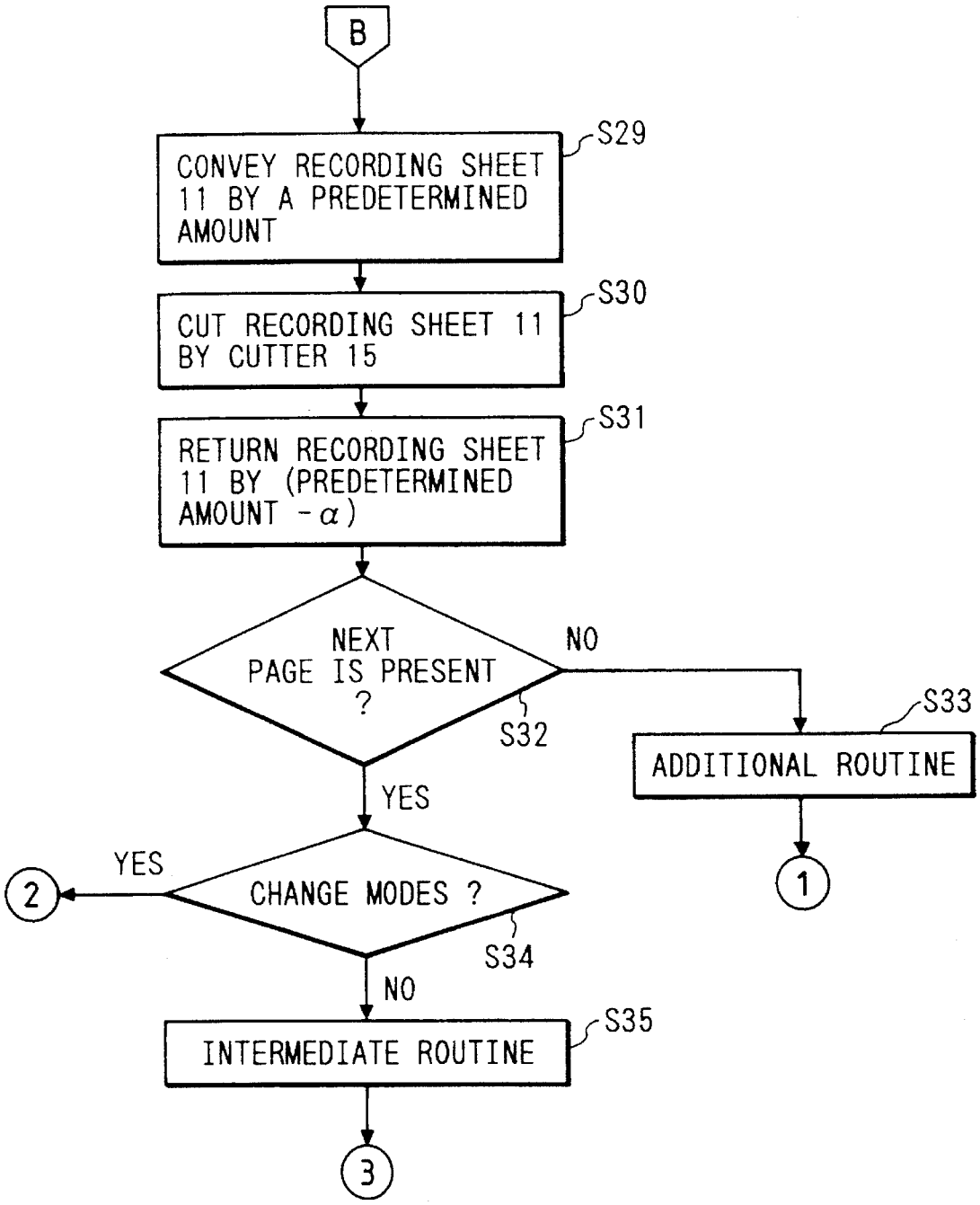

Now, FIGS. 6A–6C are flowcharts showing the receiving and recording processes in a facsimile apparatus according to the present embodiment. The control program for executing these processes is stored in ROM 114 in control unit 101. Here it is assumed that the installation of multiink sheet has already been detected by control unit 101 by means of switch 103*a*, etc.

First, at a step S1, CML is turned off, and at a step S2, the processing is examined to determine whether it is for a receiving or not. If the mode is not receiving, the other processing required is executed at a step S4. If the mode is a receiving, the process proceeds to a step S3 to turn CML on. Thus, at a step S5, a preparatory procedures for the receiving mode are taken to input a transmission speed being received from the transmitter side and store it RAM 115. Thus, subsequently, the image signals being transmitted from the equipment of the other party are inputted and stored in line memory 110 after decoding.

Next, the process proceeds to a step S6 and when a one-line portion of recording data is decoded and stored in line memory 110, that portion is output in serial to shift register 130. Then, at a step S7, the transportation of recording data for one line is examined to verify its completion, and when the transportation is terminated, latch signal 44 is output at a step S8 to store recording data for one line in latch circuit 131. Next, the process proceeds to a step S9 to find its recording mode. If it is found to be superfine mode at the step S9, the process proceeds to a step S10 to set "1" in line counter 1. Also, at a step S11, if fine mode is found, the process proceeds to a step S12 to set "2" in 1, and if the mode is other than those (i.e. , standard mode) , the process proceeds to a step S13 to set "4" in 1. This value of line counter 1 indicates the number of lines constituting a one line of image data corresponding to each of the recording modes. For example, while in the case of superfine mode, a one line of image data is recorded in one line, in the case of standard mode where the density of recording pixels is the lowest, a one line of image data comprises a four-line portion of the same image data.

Next, the process proceeds to a step S14 to convey recording sheet 11 for one half step. At a step S15, the transmission speed instructed from the equipment of the side of the other party and recorded in RAM 115 at the step S5 is read to examine whether or not this speed is 9,600 (b/s). If it is found to be 9,600 b/s, ink sheet 14 is conveyed at a step S16 for four half steps (n=25/4). Against this, if the transmission speed is 7,200 b/s, the process proceeds to a step S18 to convey ink sheet 14 for five half steps (n=25/5). Also, if the transmission speed is other than those, the process proceeds to a step S19 to convey ink sheet 14 for six half steps (n=25/6).

Thus, the process proceeds to a step S20 energize one of the blocks of heat generating resistor 132 of thermal head 13. Then at a step S21, an examination is made to determine whether or not the entire blocks of heat generating resistor 132 of thermal head 13 have been energized. If the entire blocks have not been energized, the process proceeds to a step S25 to transport the next line of image data to shift resistor 130 of thermal head 13 at the step S25 to step S28. Thus, at the step S27, when the period to energize (600 μs) is over, process proceeds to the step S20 to energize the next block. In this respect, according to the present embodiment, the thermal head 13 is divided into four blocks (m=4) for driving, and for example, the time required for recording one line in superfine mode is approximately 2.5 ms (600 μs ×4 blocks).

At the step S21, when the entire blocks are energized to complete the one line recording, the process proceeds to the step S22 to set −1 in 1 to examine whether or not the 1 line has been recorded in response to each of the recording modes, and at the step S23, if no 1 line is found to be recorded, the process returns to the step S14 to convey recording sheet 11 for one half step and ink sheet 14 for four to six half steps in accordance with the transmission speeds, and again record one line for the same data.

When the 1 line recording is thus executed in accordance with each of the recording modes, the process proceeds from the step S23 to the step S24 to examine whether or not the recording processing for one page has been completed. If the recording processing for one page has not been completed, the process returns to the step S6 to execute the aforesaid image recording processing.

If the image recording for one page has been completed, the process proceeds to a step S29 to convey recording sheet 11 for a predetermined amount in the direction towards exhausting sheet rollers 16 (16*a* and 16*b*) and at the same time, to drive cutters 15 (15*a* and 15*b*) and a step S30 to engage with each other to cut recording sheet 11 into a unit of one page. Then the recording sheet 11 thus cut is exhausted by exhausting sheet rollers 16 to the outside of the apparatus and at the same time, the remaining recording sheet 11 is withdrawn at a step S31 for a distance (a predetermined amount—α) equivalent to the space between thermal head 13 and cutters 15 at the step S31.

At a step S32, the presence of recording data for the next page is examined, add if there is no more data for the next page, the process proceeds to a step S33 and returns to the step S1 after having taken the final procedures. Also, if there is recording data for the next page, the process proceeds from the step S32 to a step S34 to examine whether or not there is any shift in mode for transmission speed, etc. If there is any shift, the process returns to the step S5. If there is no instruction for mode shifting, an intermediate processing is executed at a step S35, and the process returns to the step S6 to execute the aforesaid processing.

FIG. 7 shows the distance to convey a one-line portion of recording sheet 11 in each of the recording modes.

Here, in consideration of the half step driving, motor 24 for conveying recording sheet is driven to convey recording sheet 11 for 1/15.4 mm at one half step. Then, for one line in superfine mode, motor 24 for conveying recording sheet is driven for one half step, and for one line in fine mode, it is driven for two half steps. Further, in standard mode, it is driven for four half steps against one line.

FIG. 8 shows step numbers required to convey ink sheet 14 for one line in each of the recording modes according to the present embodiment.

In the present embodiment, motor 25 for conveying ink sheet conveys ink sheet 14 for a distance of {(1/15.4) ×1/5×1/5} mm at a half step. Therefore, in superfine mode, n rotatably drives motor 25 for conveying ink sheet for "4", "5", and "6" half steps respectively in the order of large, medium, and small to convey ink sheet 14 accordingly. Likewise, in fine mode, n drives "8" "10" and "12" half steps respectively in the order of large, medium, and small, and in standard mode, the motor is driven in the order of n values for "16" "20" and "24" accordingly.

As above describes, in superfine mode, for example, where n is large, the conveying ratio (n) between recording sheet 11 and ink sheet is (5×5)×¼=25/4, where n is medium, the ratio is (5×5)×⅕=25/5, and where n is small, the ratio is (5×5)×⅙=25/6. Also, whenever recording sheet 11 is conveyed for one half step, ink sheet 14 is conveyed for four to six half steps.

In this respect, since the present embodiment has been described taking a facsimile apparatus as an example, the conveying amount of ink sheet 14 is adjusted (n value is adjusted) in accordance with the transmission speeds as shown in steps S15 to S19. However, in a general thermal transfer printer, etc., for example, it is also possible to adjust the conveying amount of ink sheet 14 (n value) in response to the states of switch 103*b* for shifting speeds as shown in FIG. 2.

Figure 9A:
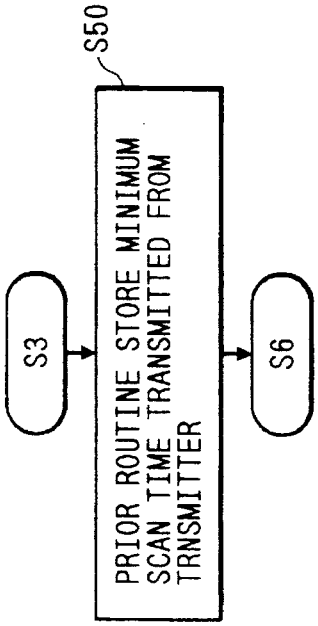
FIGS. 9A–9B and FIGS. 10A–10B are flowcharts showing the recording process according to another embodiment.
Figure 9B:
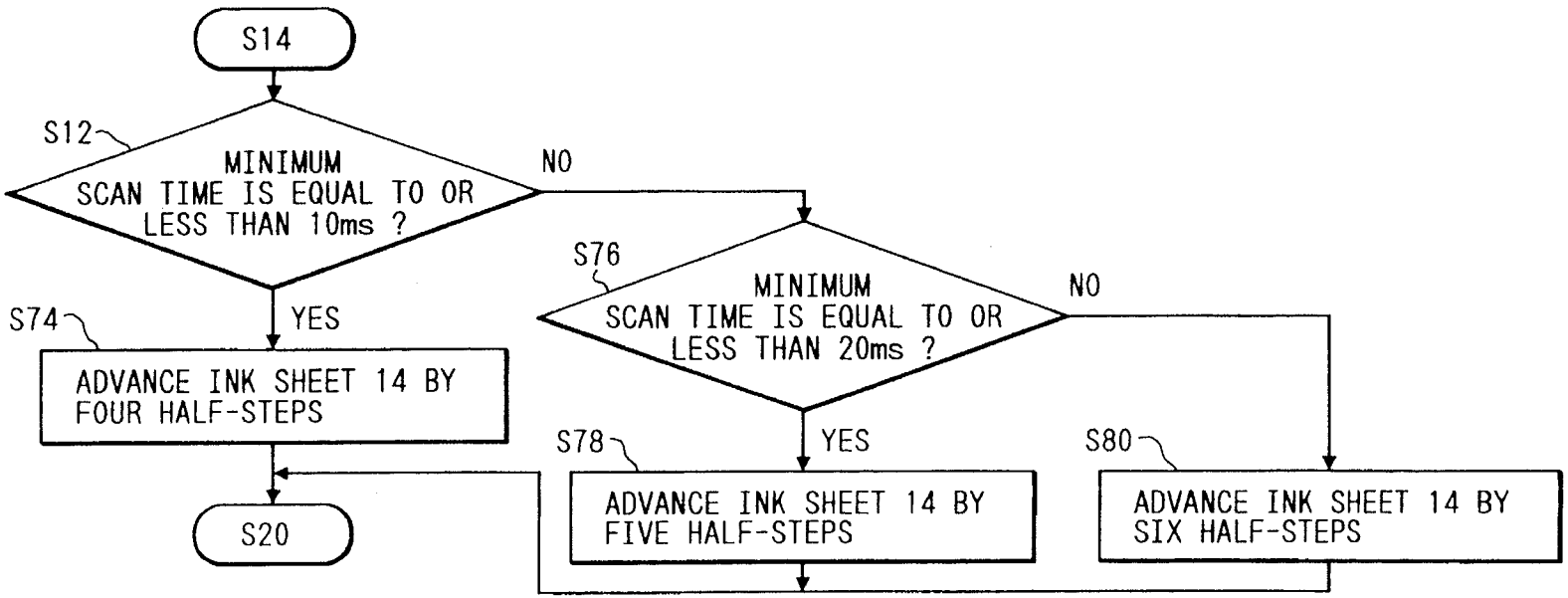

Also, in the aforesaid embodiment, although the value n is adjusted on the basis of the transmission speeds instructed by the equipment of the other party, it may be possible to define an n value based on the minimum scanning time declared by the equipment of the other party, for example. FIGS. 9A and 9B illustrate this. According to the present embodiment, in place of the step S5 in FIGS. 6A–6C, the minimum scanning time notified is stored in RAM 115 at a step S50, and in place of the steps S15 to S19 shown in FIG. 6, the conveying length of ink sheet 14 is defined in response to each of the minimum scanning times at steps S72 to S80. For example, if a minimum scanning time is less than 10 ms, ink sheet 14 is conveyed for four half steps (n=25/4) at a step S74. Also, if a minimum scanning time exceeds 10 ms but less than 20 ms, ink sheet 14 is conveyed for five half steps (n=25/5) at a step S78. Further, if a minimum scanning time exceeds 20 ms, the process proceeds to a step S80 to convey ink sheet 14 for six half steps (n=25/6).

Furthermore, as another embodiment, it is possible to adjust n values in accordance with recording cycles. In other words, if a recording cycle is short, the value n should become great, and if a recording cycle is long, the value n should become small to perform the respective recordings. A flowchart shown in FIGS. 10A–10B illustrate this.

In other words, a timing is set by timer 116 for the period from the completion of current line to the recording of next line becoming possible, and an n value is adjusted in accordance with a period thus set by such timing.

Figure 10A:
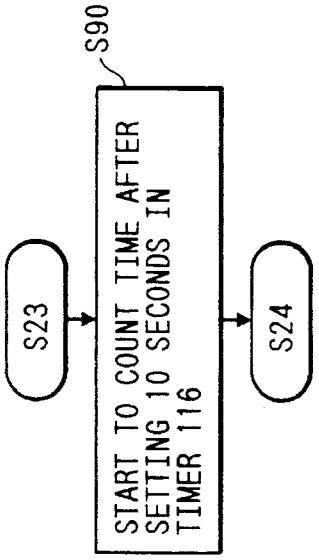
Figure 10B:
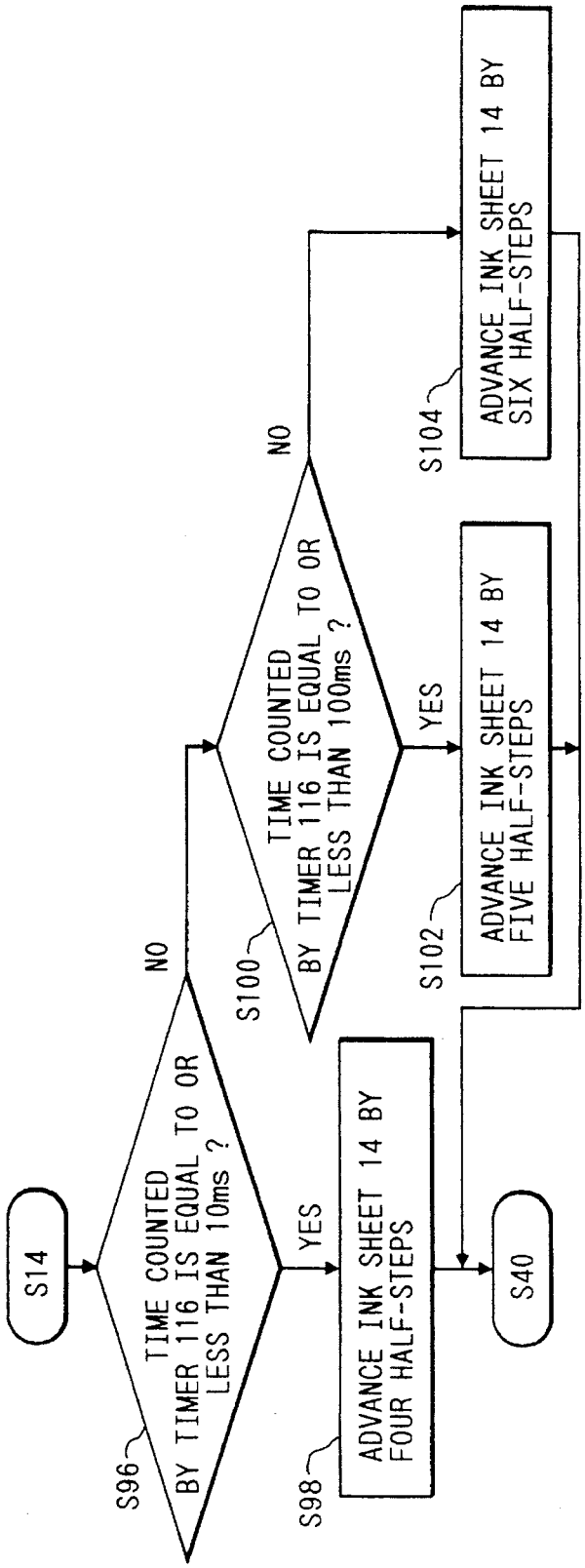

Here, as shown in FIG. 10A, a period of 10 seconds is set for timer 116 and a processing is inserted between the steps S23 and S24 shown in FIGS. 6A–6C to start the timing. Then, as shown in FIG. 10B, a processing to define an n value in accordance with such timing is provided in place of the steps S15 to S19 shown in FIGS. 6A–6C.

Thus, if the timing by timer 116 is less than 10 ms, ink sheet 14 is advanced for four half steps (n=25/4) at a step S98. If it exceeds 10 ms but less than 100 ms, ink sheet 14 is conveyed for five half steps (n=25/5) at a step S102. Also, if the timer by timer 116 exceed 100 ms, the process proceeds to a step S104 to convey ink sheet 14 for six half steps (n=25/6).

In this respect, the established values of n value in the aforesaid embodiments are not limited to those defined therein as a matter of course.

As above describes, according to the present embodiment, it is possible to save ink sheet for its effective use by adjusting the relative length to convey recording sheet and ink sheet in accordance with the recording cycles or the minimum scanning times and at the same time, to obtain an effect that the recording density is maintained at a constant level to improve the quality of recorded image.

As set forth above, according to the present embodiment, there is an advantage that while ink sheet can be saved by making the conveying amount of ink sheet against recording medium small when the recording cycle is short, an excellent image is recorded by making the conveying amount of ink sheet large when the recording cycle is long.

Subsequently, as an embodiment wherein the image quality is not lowered even when the recording modes are shifted, an example will be described, in which an image to be recorded is detected to determine whether or not it is half tone, and if a half tone image is detected, an action is taken to make the conveying amount of ink sheet against recording medium large for its recording. In this respect, as in the aforesaid embodiment, FIG. 1 to FIG. 4 and the descriptions thereof are referenced in an embodiment hereinafter set forth.

Figure 11:
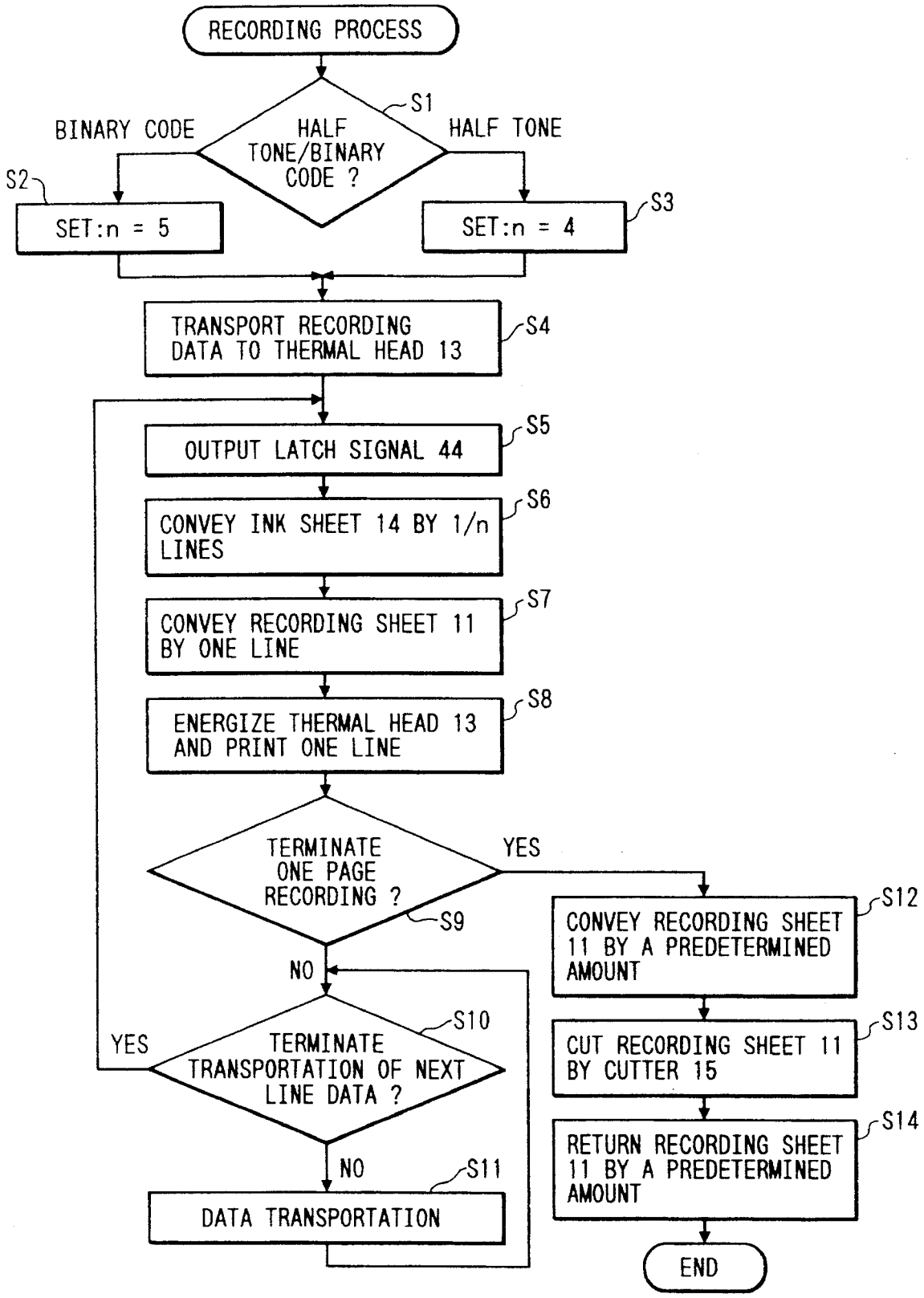
FIG. 11 is a flowchart showing the recording process according to the present embodiment.

Now, FIG. 11 is a flowchart showing the image recording process for one page portion in a facsimile apparatus according to the present embodiment, and the control program for executing this process is stored in ROM 114 in control unit 101. This process is started when the image recording action is ready to start after a one-line portion of image data of the image to be recorded has been stored in line memory 110. Then, here, it is assumed that the installment of multiink sheet has already been detected by control unit 101 by means of switch 103a, etc.

First, at a step S1, an image received is examined to determine whether it is a binary image or a half tone image. This is determined on the basis of control information included in the control signal (for example, NSF) transmitted from a facsimile apparatus on the transmitting side. This control information has been stored in RAM 115 at the time of receiving signals, and in accordance with this stored information, the image currently stored in line memory 110 is judged for a binary image or a half tone image. If it is found to be a binary image, the process proceeds to a step S2 to set n at "5". On the other hand, if it is found to be a half tone image, the process proceeds to a step S3 to set n at "4".

Next, at a step S4, a one-line portion of recording data is output in serial to shift register 130 of thermal head 13. Then, when the recording data for one line has completely been transported, latch signal 44 is output at a step S5 to store the one line portion of recording data in latch circuit 131. Subsequently at a step S6, motor 25 for conveying ink sheet is driven to convey ink sheet 14 for l/n line in the direction indicated by an arrow a in FIG. 4. Then at a step S7, motor 24 for conveying recording sheet 11 is driven to convey only for one line portion (in the present embodiment, 1/15.4 mm).

Thus, the one-line portion of recording data is transported to thermal head 13, and when ink sheet 14 and recording sheet 11 are started to be conveyed, the process proceeds to a step S8 to energize each unit of blocks of heat generating resistor 132 of thermal head 13 to perform the transfer recording for the one line. In this respect, at the time of this one-line recording, the recording data of the next line, if any exists, is sequentially transported to shift register 130 of thermal head 13.

When the one-line recording is thus performed, the process proceeds to a step S9 to examine whether or not the image recording for a one page has been completed. If the recording for the one page has not been completed, the process proceeds to a step S10 to examine whether or not the next line of recording data has already been transported to thermal head completely. If the transportation has not been completed, the data of the next line is transported at a step S11. The process returns to the step S5 from the step S10 when the entire data of the next line has been transported to shift register 130 of thermal head 13. Then the aforesaid recording process is performed.

Thus, when the image recording for one page portion is completed at the step S9, the process proceeds to a step S12 to convey recording sheet 11 for a predetermined amount in the direction towards exhausting sheet rollers 16 (16*a* and 16*b*) and at the same, to drive cutters 15 (15*a* and 15*b*) to engage with each other at a step S23 to cut recording sheet 11 into a unit of one page. Then, at the same time of exhausting recording sheet 11 thus cut to the outside of the apparatus by means of exhausting sheet rollers 16, the recording for one page is completed at a step S14 by withdrawing the remaining recording sheet 11 for a distance equivalent to the space between thermal head 13 and cutters 15.

Hence, according to the present embodiment, when a half tone image is recorded, the conveying length of ink sheet 14 against recording sheet 11 is longer than when a binary image is recorded. In this way, the amount of ink contained in ink sheet 14 transferred onto recording sheet 11 is increased as the half tone image is recorded, so that a half tone image requiring a slower recording speed can be recorded in the same density as a binary image.

Also, there is an advantage that ink sheet is saved when a binary image is recorded because it is possible to elongate the length to convey ink sheet against recording sheet by making the n value large.

As set forth above, according to the present embodiment, there is also an advantage that a half tone image can be recorded in the same density as the other image by making the amount to convey ink sheet against recording medium large when the half tone image is recorded.

Figure 12:
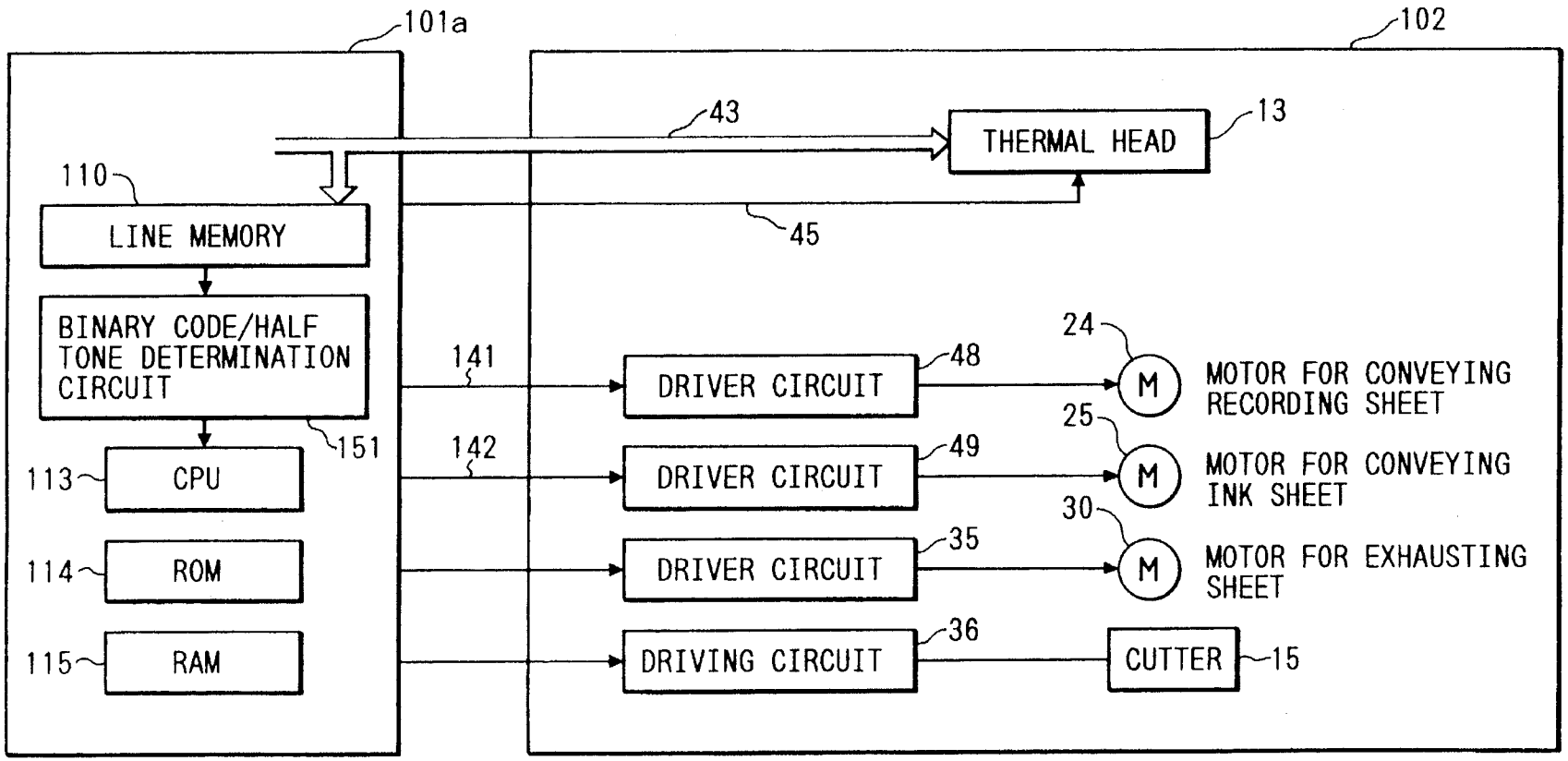
FIG. 12 is a view showing the connection between the control unit and the recording unit of a facsimile apparatus according to the present embodiment.

FIG. 12 is a block diagram showing the electrical connection of control unit and recording unit of a facsimile apparatus according to another embodiment.

In the aforesaid embodiment, the discrimination between binary image and half tone image is judged by control signal transmitted from the equipment on the transmitting side. Here, such discrimination is judged by based on the receiving image data stored in line memory 110. This judgement is performed by binary/half tone image discriminating circuit 151. In general, a half tone image is represented by dot patterns in its intermediate portion, and as compared with a binary image, the number of white-black inversion in the main scanning direction becomes extremely great. Therefore, it is possible to discriminate half tone image from binary image in accordance with this number, large or small, of the white-black inversion in the main scanning direction.

Hence this binary/half tone image discriminating circuit 151 examines the number of white-black inversion of image data in the main scanning direction and takes it as a half tone image if such number detected is more than a given number. The result is output to CPU 113. Then this enables CPU 113 to judge whether the image data currently stored in line memory 110 is a half tone image or a binary image. This judgement may also be made by control program for CPU 113 stored in ROM 114.

[Description of Recording Principle (FIG. 13)]

Figure 13:
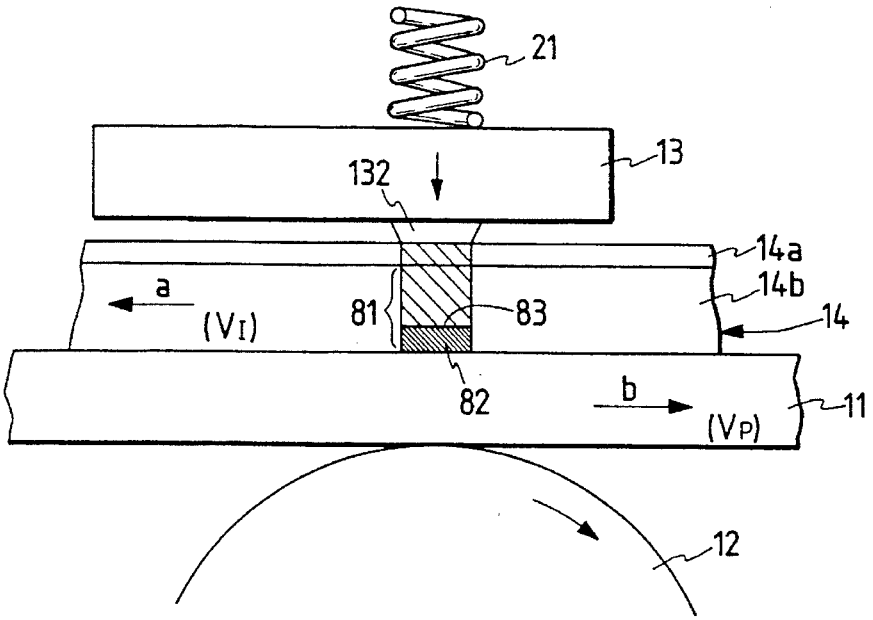
FIG. 13 is a view showing the states of recording sheet and ink sheet at the time of recording in the present embodiment.

FIG. 13 is a view showing a state of image recording when an image is recorded with recording sheet 11 and in sheet 14 being conveyed in the opposite direction using multiink sheet.

As shown in the figure, recording sheet 11 and ink sheet 14 are pinched between platen roller 12 and thermal head 13. The thermal head 13 is pressurized by spring 21 under a given pressure against platen roller 12. Here, recording sheet 11 is conveyed by the rotation of platen roller 12 at a speed Vp in the direction indicated by an arrow b. Meanwhile, ink sheet 14 is conveyed by the rotation of motor 25 for conveying ink sheet at a speed V1 in the direction indicated by an arrow a.

Now, when the heat generating resistor 132 of thermal head 13 is heated by current from power source 105, the portion 91 of ink sheet 14 indicated by slashed lines is heated. Here a numeral **14*a* denotes the base film of ink sheet 14; and 14*b* is the ink layer of ink sheet 14. When heat generating resistor 132 is energized, ink in the heated ink layer 91 is molten, and a portion thereof indicated by a numeral 92 is transferred onto recording sheet 11. This portion 92 of the ink layer to be transferred is almost equivalent to a l/n of the portion of the ink layer indicated by a numeral 91**.

DESCRIPTION OF INK SHEET (FIG. 14)

Figure 14:
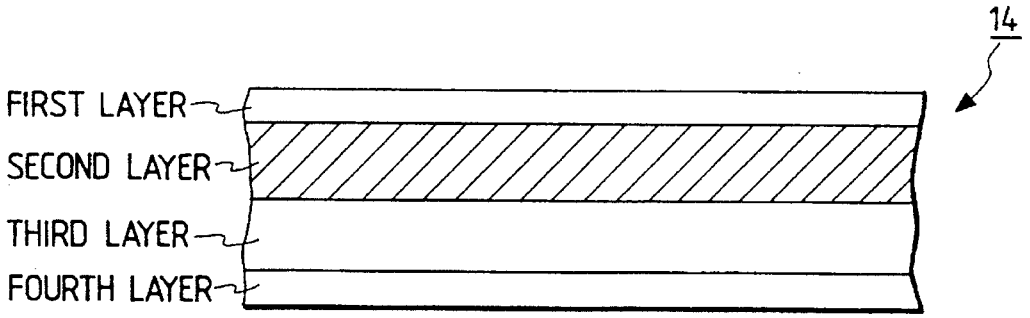
FIG. 14 is a cross-sectional view showing the structure of a multiink sheet used in the present embodiment.

FIG. 14 is a cross-sectional view of ink sheet used for a multiprint according to the present embodiment. Here the ink sheet comprises four layers.

First, a second layer is the base film which is a member to support ink sheet 14. In the case of multiprint, since heat energy is applied repeatedly to a same location, it is advantageous to use a high heat resistive aromatic polyamide film or condenser paper, but the conventional polyester film can also be applicable. Although the thickness of the film should be as thin as possible for a better printing quality from the viewpoint of its role as a medium, the thickness of 3–8 μm is desirable from the viewpoint of its strength required.

A third layer is the ink layer containing an amount of ink capable of being transferred onto recording paper (recording sheet) repeatedly for n times. The components thereof are resin such as EVA, etc. as adhesive, carbon black and nigrosine dye for coloring agent, and carnauba wax, paraffin wax, etc. for binding agent. These elements are appropriately mixed as principle components to enable the layer to withstand a repeated application at a same location for n times. It is desirable to coat this layer in an amount of 4–8 $g/m^2$. However, as its sensitivity and density differ depending on the coating amount, such amount can arbitrarily be selected.

A fourth layer is the top coating layer to prevent ink in the third layer from being transferred by pressure to ink sheet at a location where no printing is performed. This layer comprises transparent wax, etc. Thus, the fourth layer which is transparent is the only portion to be transferred by pressure, and this prevents recording sheet from being stained. A first layer is the heat resistive coating layer to protect the second layer which is the base film from the heat of thermal head 13. This is suited for the multiprint for which heat energy for n lines is often applied to a same portion (when black information continues), but its application is arbitrarily selective. Also, this is effectively applicable to a base film with comparatively low heat resistivity such as polyester film.

In this respect, the composition of ink sheet 14 is not limited to the present embodiment. For example, ink sheet can also be formed with a base layer and a porous ink retaining layer containing ink which is provided at one end of the base layer, or having fine porous netting structure provided on the base film to contain ink. Also, as the materials for base film for example, film or paper comprising polyamide, polyethylene, polyester, polyvinyl chloride, triacetilene cellulose, nylon, etc. can be used. Further, although heat resistive coating is not necessarily required, its material may also be, for example, silicon resin, epoxy resin, fluorine resin, etholocellulose, etc.

Also, as an example of ink sheet containing heat sublimating ink, there is an ink sheet in which a coloring layer containing spacer particles and dye comprising guanamine resin and fluorine resin is formed on a substrate comprising polyethylene terephtharate, aromatic polyamide film, etc.

Also, a heating method in thermal transfer printer is not limited to the thermal head method using the aforesaid thermal head. The heating method using, for example, a current-carrying or laser transfer may also be employed.

Also, in the present embodiment, the description has been made of an example in which the thermal line head is used, but the application is not limited to this. A thermal transfer printer of so-called serial type may also be employed. Further, although the description has been made of multi-printing in the present embodiment, the application is not limited to this. An ordinary thermal transfer recording using one-time ink sheet can be employed as a matter of course.

Also, the recording medium is not limited to recording sheet. If only a material is capable of accepting ink transfer, cloth, plastic sheet or the like can be used as a recording medium. Also, the ink sheet is not limited to rolled type as shown in the present embodiment. It can be, for example, an ink sheet contained in a housing which can detachably installed in the main body of recording apparatus, i.e., the so-called ink sheet cassette type whereby such housing containing ink sheet is detachably mounted as it is in the main body of the recording apparatus.

Also, in each of the aforesaid embodiments, the description has been made of a facsimile apparatus. The present invention, however, is not limited to such application. It can also be applicable, for example, to word processors, typewriters or copying machines, etc.

In addition, the ink sheet is not limited to the rolled type as shown in the embodiments. It is also possible to employ, for example an ink sheet contained in a housing which can detachably installed in the main body of recording apparatus, i.e., the so-called ink sheet cassette type, etc. whereby such housing containing ink is detachably mounted as it is in the main body of the recording apparatus.

As set forth above in detail, it is possible to provide by the present invention a thermal transfer recording apparatus and a facsimile apparatus wherein the quality of image recorded is not lowered even when the recording modes are shifted.

We claim:

1. A thermal transfer recording apparatus for transferring an ink of an ink sheet onto a recording medium to record an image on said recording medium, said apparatus comprising:

a recording medium mounting section for mounting said recording medium;

an ink sheet mounting section for mounting said ink sheet, said ink sheet mounting section accepting a multi-print ink sheet containing said ink in an amount sufficient to record plural times;

recording medium conveying means for conveying said recording medium in a sub-scan direction;

ink sheet conveying means for conveying said ink sheet;

a thermal head for selectively transferring said ink from said ink sheet to said recording medium so as to record a line of an image according to recording information across said recording medium perpendicular to said sub-scan direction;

discriminating means for discriminating a recording mode of the image to be recorded;

first control means for controlling a ratio of a conveyance amount of said ink sheet to a conveyance amount of said recording medium in accordance with the recording mode discriminated by said discriminating means so as to maintain constant a recording density of the recorded line of the image; and second control means for controlling said thermal head to perform repeatedly a recording based on a same recording information a number of times which varies in accordance with the recording mode discriminated by said discriminating means, wherein said number of times is a first number of times in a predetermined recording mode and a second number of times, different from said first number of times, in another recording mode different from said predetermined recording mode, and where in each said recording mode said thermal head performs repeatedly said recording on an area of said recording medium having a different length in said sub-scan direction, so that a total number of recordings performed in a given length in said sub-scan direction is constant for each said recording mode.

2. An apparatus according to claim 1, wherein during recording a conveyance length of said ink sheet conveyed by said ink sheet conveying means is shorter than a conveyance length of said recording medium conveyed by said recording medium conveying means.

3. An apparatus according to claim 1, wherein said apparatus is a facsimile apparatus comprising receiving means for receiving external image information through a communication line.

4. A thermal transfer recording apparatus for transferring an ink of an ink sheet onto a recording medium to record an image on said recording medium, said apparatus comprising:

a recording medium mounting section for mounting said recording medium;

an ink sheet mounting section for mounting said ink sheet, said ink sheet mounting section accepting a multi-print ink sheet containing said ink in an amount sufficient to record plural times;

recording medium conveying means for conveying said recording medium in a sub-scan direction;

ink sheet conveying means for conveying said ink sheet, said ink sheet conveying means conveying said ink sheet in a direction different from a conveyance direction of said recording medium at a recording area during recording;

a thermal head having a plurality of heat generating elements disposed along a recordable maximum width of said recording medium, said head being mounted on said recording medium mounting section to selectively transfer said ink from said ink sheet to said recording medium so as to record a line of an image according to recording information across said recording medium perpendicular to said sub-scan direction;

discriminating means for discriminating a value of a recording mode of the image to be recorded;

first control means for controlling a ratio of conveyance amount of said ink sheet to a conveyance amount of said recording medium in accordance with the recording mode discriminated by said discriminating means so as to maintain constant a recording density of the recorded line of the image; and second control means for controlling said thermal head to perform repeatedly a recording based on a same recording information a number of times which varies in accordance with the recording mode discriminated by said discriminating means, wherein said number of times is a first number of times in a predetermined recording mode and a second number of times, different from said first number of times, in another recording mode different from said predetermined recording mode, and where in each said recording mode said thermal head performs repeatedly said recording on an area of said recording medium having a different length in said sub-scan direction, so that a total number of recordings performed in a given length in said sub-scan direction is constant for each said recording mode.

5. An apparatus according to claim 4, wherein during recording a conveyance length of said ink sheet conveyed by said ink sheet conveying means is shorter than a conveyance length of said recording medium conveyed by said recording medium conveying means.

6. An apparatus according to claim 4, wherein said apparatus is a facsimile apparatus comprising receiving means for receiving external image information through a communication line.

7. A thermal transfer recording apparatus for transferring an ink of an ink sheet onto a recording medium to record an image on said recording medium, said apparatus comprising:

recording medium conveying means for conveying said recording medium in a sub-scan direction;

ink sheet conveying means for conveying said ink sheet;

recording means for acting on said ink sheet to record on said recording medium a predetermined amount of the image according to a recording information, said recording means recording said predetermined amount of the image in a main scan direction different from the sub-scan direction;

signal generating means for generating a signal representative of a recording mode according to information involved in an image to be recorded;

first control means for controlling a ratio of a conveyance amount of said ink sheet to a conveyance amount of said recording medium at recording in accordance with the signal generated from said signal generating means so as to maintain constant a recording density of said predetermined amount of the image recorded by said recording means; and second control means for controlling said recording means to perform repeatedly a recording based on a same recording information a number of times which varies in accordance with the signal generated from said signal generating means, wherein said second control means controls said recording means in such a manner that in a predetermined recording mode said recording means performs repeatedly a recording based on a same recording information a first number of times, and in another recording mode different from said predetermined recording mode, said recording means performs repeatedly a recording based on a same recording information a second number of times different from said first number of times, and wherein a length in said sub-scan direction of an area of said recording medium on which a recording based on a same recording information is performed said first number of times in said predetermined recording mode is different from to a length in said sub-scan direction of an area of said recording medium on which a recording based on a same recording information is performed said second number of times in said other recording mode, so that a total number of recordings performed in a given length in said sub-scan direction is constant for each said recording mode.

8. An apparatus according to claim 7, wherein said information involved in the image to be recorded relates to a recording pixel density in the sub-scan direction as to the recording based on the recording information.

9. An apparatus according to claim 8, wherein said second control means controls so that the number of times for recording based on a same recording information in a recording mode in which recording information involved in a relatively high recording pixel density is recorded is less than the number of times for recording based on a same recording information in a recording mode in which recording information involved in a relatively low recording pixel density is recorded.

10. An apparatus according to claim 7, wherein said ink sheet and said recording medium are conveyed in opposing directions.

11. An apparatus according to any of claims 7 to 10, wherein said predetermined amount of image is a line of the image in the main scan direction.

12. An apparatus according to claim 7, further comprising receiving means for receiving information transmitted from a party, wherein said recording means records recording information in accordance with the information received by said receiving means.

* * * * *

UNITED STATES PATENT AND TRADEMARK OFFICE

CERTIFICATE OF CORRECTION

PATENT NO. : 5,534,908

DATED : July 9, 1996

INVENTOR(S) : Tomoyuki Takeda et al.

It is certified that error appears in the above-identified patent and that said Letters Patent is hereby corrected as shown below:

COLUMN 3

Line 16, "flowcharts." should read --flowcharts showing the recording process according to the present embodiment.--.
Line 24, "showing-the" should read --showing the--.

COLUMN 4

Line 9, "coped," should read --copied,--.
Line 35, ".an" should read --an--.

COLUMN 6

Line 28, "programmable-timer." should read --programmable timer.--.
Line 54, "Numeral 141" should read --Numerals 141--.

COLUMN 7

Line 18, "thus" should read --are thus--.
Line 25, ".sheet" should read --sheet--.
Line 46, "record" should read --records--.

COLUMN 8

Line 66, "a preparatory" should read --preparatory--.

UNITED STATES PATENT AND TRADEMARK OFFICE

CERTIFICATE OF CORRECTION

PATENT NO. : 5,534,908

DATED : July 9, 1996

INVENTOR(S) : Tomoyuki Takeda et al.

It is certified that error appears in the above-identified patent and that said Letters Patent is hereby corrected as shown below:

COLUMN 9

Line 1, "it" should read --it in--.
Line 17, "(i.e. ," should read --(i.e.,-- and "mode) ," should read --mode),--.
Line 38, "energize" should read --to energize--.
Line 47, "process" should read --the process--.

COLUMN 10

Line 12, "amount—α)" should read --amount-α)--.
Line 15, "add" should read --and--.
Line 47, " "16" "20" " should read --"16", "20",--.
Line 48, "above describes," should read --described above,--.

COLUMN 11

Line 20, "illustrate" should read --illustrates--.
Line 36, "timer" (first occurrence) should read --timing-- and "exceed" should read --exceeds--.
Line 42, "above describes," should read --described above,--.

UNITED STATES PATENT AND TRADEMARK OFFICE

CERTIFICATE OF CORRECTION

PATENT NO. : 5,534,908

DATED : July 9, 1996

INVENTOR(S) : Tomoyuki Takeda et al.

It is certified that error appears in the above-identified patent and that said Letters Patent is hereby corrected as shown below:

COLUMN 13

Line 24, "by" should be deleted.
Line 47, "in" should read --ink--.
Line 57, "speed VI" should read --speed $V_1$--.
Line 62, "portion 91" should read --portion 81--.
Line 66, "layer 91" should read --layer 81--.
Line 67, "numeral 92" should read --numeral 82--.

COLUMN 14

Line 1, "portion 92" should read --portion 82--.
Line 3, "numeral 91" should read --numeral 81--.
Line 52, "acetilene" should read --acetylene--.
Line 55, "etholocellulose" should read --ethylcellulose--.
Line 60, "terephtharate," should read --terephthalate--.

COLUMN 15

Line 11, "can" should read --can be--.
Line 23, "example" should read --example,-- and "can" should read --can be--.

UNITED STATES PATENT AND TRADEMARK OFFICE

CERTIFICATE OF CORRECTION

PATENT NO. : 5,534,908

DATED : July 9, 1996

INVENTOR(S) : Tomoyuki Takeda et al.

It is certified that error appears in the above-identified patent and that said Letters Patent is hereby corrected as shown below:

COLUMN 18

Line 10, "to" should be deleted.

Signed and Sealed this

First Day of April, 1997

Bruce Lehman

*Attest:*

BRUCE LEHMAN

*Attesting Officer*

*Commissioner of Patents and Trademarks*